US008181764B2

(12) United States Patent
Cha et al.

(10) Patent No.: US 8,181,764 B2
(45) Date of Patent: May 22, 2012

(54) MEDIA DEPOSIT APPARATUS AND METHOD FOR CONTROLLING THE SAME

(75) Inventors: Jin Hwan Cha, Anyang-si (KR); Young Il Choi, Seoul (KR); Dong Sik Lee, Seoul (KR); Hyun Soo Kim, Anyang-si (KR); Sung Jin Moon, Suwon-si (KR)

(73) Assignee: Nautilus Hyosung Inc., Seoul (KR)

( * ) Notice: Subject to any disclaimer, the term of this patent is extended or adjusted under 35 U.S.C. 154(b) by 302 days.

(21) Appl. No.: 12/392,801

(22) Filed: Feb. 25, 2009

(65) Prior Publication Data

US 2009/0216365 A1 Aug. 27, 2009

(30) Foreign Application Priority Data

Feb. 26, 2008 (KR) ..... 10-2008-0017380

(51) Int. Cl.
*G07F 7/04* (2006.01)

(52) U.S. Cl. ..... 194/206

(58) Field of Classification Search ..... 194/206, 194/207, 344, 356, 350; 209/534; 902/8, 902/9, 11, 12, 13, 14, 15
See application file for complete search history.

(56) References Cited

U.S. PATENT DOCUMENTS 4,542,287 A * 9/1985 Watanabe ..... 235/379
4,726,474 A * 2/1988 Arikawa et al. ..... 209/534

* cited by examiner

*Primary Examiner* — Mark Beauchaine
(74) *Attorney, Agent, or Firm* — Fenwick & West LLP

(57) ABSTRACT

Provided is a media deposit apparatus including: a deposit transfer portion providing a deposit circulation path of media deposited via a media deposit portion; a temporary transfer portion providing a temporary circulation path that contacts with the deposit circulation path to transfer the media to a temporary stack portion, and including a temporary stack gate, provided between the deposit circulation path and the temporary circulation path, to selectively convert a path of media to the temporary circulation path; and a media transfer portion providing a media transfer path that contacts with the temporary circulation path to transfer the media to a media storage portion, and including a media storage gate, provided between the temporary circulation path and the media transfer path, to selectively convert the path of media to the media transfer path. Accordingly, it is possible to simplify a media transfer structure and to enhance a media transfer efficiency.

5 Claims, 10 Drawing Sheets

MEDIA DEPOSIT APPARATUS AND METHOD FOR CONTROLLING THE SAME

CROSS-REFERENCE TO RELATED APPLICATION

This application claims the benefit under 35 USC §119(a) from Republic of Korea Patent Application No. 10-2008-0017380, filed on Feb. 26, 2008, in the Korean Intellectual Property Office, the disclosure of which is incorporated herein by reference.

BACKGROUND

1. Field of the Invention

The present invention relates to a media deposit apparatus that may retract a forged note, and more particularly, to a media deposit apparatus including a plurality of transfer paths that circulate in a state where the plurality of transfer paths contacts with each other, and a plurality of gates that are provided between the plurality of transfer paths.

2. Description of the Related Art

An automatic teller machine (ATM) denotes an automated device that may provide basic financial services such as deposit and withdrawal in association with financial services, without a need of a banking teller and without a restriction on a time and an occasion.

The ATM may be generally classified into a cash withdrawing device and a cash depositing device according to deposit and withdrawal. Currently, the ATM is being used for various purposes such as depositing/withdrawing of a check, a bankbook arrangement, depositing of a gyro, ticketing, and the like.

In the following detailed description, a note deposit apparatus will be described as an example but the present invention is not limited thereto. Specifically, the note deposit apparatus may be described as a media deposit apparatus that may receive various types of media such as checks, cash, various types of bills, and the like.

A conventional media deposit apparatus includes a temporary stack portion to temporarily store media in order to process the media in a bundle or stack unit. When a stack of media is temporarily stored in the temporary stack portion and a deposit transaction continues, the stack of media may be transferred to a deposit cassette box.

When forged media is included in the deposited media, the forged media may be temporarily stored in the temporary stack portion and then be rejected or be taken out.

However, when the media is forged too elaborately to determine whether it is forged, it may be more important to retract the corresponding media and thereby prevent the media from circulating in the market than to reject or return the forged media to a customer. However, the conventional media deposit apparatus does not include a unit to retract the elaborately forged media.

Also, even when the media deposit apparatus includes the unit to retract the elaborately forged media, the forged media is temporarily stored in the temporary stack portion and then is retracted and thus media transfer paths are very complex.

In the case of the elaborately forged media, European countries and the like desire the forged media to be immediately retracted from a deposit portion, instead of being temporarily stored in a temporary stack portion. Accordingly, there is a need for a new media deposit apparatus that may immediately retract forged media from a deposit portion.

SUMMARY

An aspect of the present invention provides a media deposit apparatus that may simplify a transfer path of media and may also perform a deposit, a temporary stack, a safety, a rejection, and the like even when a media transferring device uni-directionally circulates.

Another aspect of the present invention also provides a media deposit apparatus that may immediately retract forged media from a deposit portion without using another storage device, when the forged media is deposited.

Another aspect of the present invention also provides a media deposit apparatus that may simplify a connection structure of transfer paths for transferring deposited media to various types of media storage boxes.

Another aspect of the present invention also provides a media deposit apparatus that may enhance a media transfer efficiency using a plurality of transfer paths that circulate in a state where the plurality of transfer paths contacts with each other, and using a plurality of gates that are provided between the plurality of paths.

According to an aspect of the present invention, there is provided a media deposit apparatus including: a media deposit portion; a temporary stack portion to temporarily store media deposited in the media deposit portion; a media storage portion to receive the temporarily stored media from the temporary stack portion and to store the media; a deposit transfer portion to provide a deposit circulation path of the media; a temporary transfer portion to provide a temporary circulation path that contacts with the deposit circulation path to transfer the media to the temporary stack portion, and including a temporary stack gate that is provided between the deposit circulation path and the temporary circulation path to selectively convert a path of the media to the temporary circulation path; and a media transfer portion to provide a media transfer path that contacts with the temporary circulation path to transfer the media to the media storage portion, and including a media storage gate that is provided between the temporary circulation path and the media transfer path to selectively convert the path of the media to the media transfer path.

Through the above configuration, it is possible to effectively transfer the deposited media and to prevent the transfer paths of the media from becoming complex.

The deposit transfer portion, the temporary transfer portion, and the media transfer portion may uni-directionally circulate. Accordingly, even when only the gate moves in a state where the circulation direction of the transfer portions is maintained, it is possible to readily select and determine a path of the media.

The temporary transfer portion may uni-directionally circulate to transfer the media to the temporary stack portion in a sheet unit, or to receive the media from the temporary stack portion in a sheet unit. Specifically, the media to be stored in the media storage portion may be initially stored in the temporary stack portion and be subsequently transferred to the media storage portion. This is in order to enhance a deposit processing efficiency of the media by temporarily storing normal media in the temporary stack portion and then processing a stack of the media as a deposit or by rejecting or retracting the media.

The temporary stack portion may transfer or receive the media in a single outlet. The temporary transfer portion may include a media guide that is provided to be adjacent to the outlet of the temporary stack portion. In this instance, the media guide functions to let the media into the temporary stack portion along the temporary circulation path or to let the media out from the temporary stack portion towards the temporary circulation path.

According to another aspect of the present invention, there is provided a media deposit apparatus including: a media deposit portion; a temporary stack portion to temporarily store media deposited in the media deposit portion; a media storage portion to receive the temporarily stored media from the temporary stack portion and to store the media; a deposit transfer portion to provide a deposit circulation path of the media; a media recognition portion being provided on the deposit circulation path to determine whether the media is abnormal or whether the media is forged; a temporary transfer portion to provide a temporary circulation path that contacts with the deposit circulation path to transfer the media between the deposit circulation path and the temporary stack portion, and comprising a temporary stack gate that is provided between the deposit circulation path and the temporary circulation path to selectively convert a path of the media to the temporary circulation path; a media transfer portion to provide a media transfer path that contacts with the temporary circulation path to transfer the media between the temporary circulation path and the media storage portion, and including a media storage gate that is provided between the temporary circulation path and the media transfer path to selectively convert the path of the media to the media transfer path; and a specific transfer portion to provide a specific transfer path that contacts with the temporary circulation path to transfer the media between the temporary circulation path and a specific storage portion that stores forged media among the media, and including a specific storage gate that is provided between the temporary circulation path and the specific transfer path to selectively convert the path of the media to the specific transfer path. A path of the forged media determined at the media recognition portion may be converted by a forged note retraction gate that is provided between the deposit circulation path and the temporary circulation path whereby the forged media is not temporarily stored in the temporary stack portion but is transferred to the specific storage portion.

Through the above configuration, since the elaborately forged abnormal media may be separately retracted, it is possible to prevent the forged media from circulating in the market and to prevent a future forgery. Also, since the forged media may be immediately retracted not using the temporary stack portion, it is possible to enhance a retraction efficiency of the forged media and to simplify a configuration of transfer paths for retracting the forged media.

The media deposit apparatus may further include a rejection portion being provided on the deposit circulation path to store abnormal media that is determined at the media recognition portion. When the deposited media includes abnormal media, for example, torn media, folded media, and the like, it is possible to retract or take out the abnormal media via the rejection portion.

The specific storage portion may be provided on the specific transfer path and be provided within a retraction portion to retract uncollected media. Specifically, the specific storage portion may be provided on the specific transfer path, and may be provided within the retraction portion to retract the media uncollected by a customer. Also, the specific storage portion and the retraction portion may be integrally formed. Accordingly, it is possible to prevent a number of storage portions for receiving the media from increasing and to prevent the entire size of the media deposit apparatus from increasing.

The deposit circulation path, the temporary circulation path, the media transfer path, and the specific transfer path may uni-directionally circulate. Through this configuration, the above paths may circulate into the same direction at all times. Also, the paths may be connected to each other or may be separated from each other via a plurality of gates. Accordingly, it is possible to enhance a media transfer efficiency. Specifically, there may be no need to convert a circulation direction of the paths in order to transfer the media.

The temporary circulation path may include a first temporary circulation path that simultaneously contacts with the deposit transfer path and the specific transfer path and a second temporary circulation path that contacts with the media transfer path. A driving unit to circulate the deposit circulation path, the first temporary circulation path, and the specific transfer path may be different from a driving unit to circulate the second temporary circulation path and the media transfer path. Accordingly, in comparison to circulate all the paths using a single driving unit, it is possible to prevent overloads and to enhance a convenience of maintaining and repairing the driving unit.

According to still another aspect of the present invention, there is provided a method of controlling a media deposit apparatus comprising a media deposit portion, a temporary stack portion to temporarily store media deposited in the media deposit portion, a media storage portion to receive the temporarily stored media from the temporary stack portion and to store the media, a specific storage portion to store forged media among the media, and a rejection portion to store abnormal media among the media, the method including: transferring the deposited media from the media deposit portion in a sheet unit; determining whether the media is abnormal or whether the media is forged; transferring the media to a temporary circulation path; determining whether to convert, to the rejection portion, a path of the media that circulates together with the temporary circulation path; determining whether to convert, to the temporary stack portion, the path of the media that circulates together with the temporary circulation path; determining whether to convert, to the media storage portion, the path of the media that circulates together with the temporary circulation path; and determining whether to convert, to the specific storage portion, the path of the media that circulates together with the temporary circulation path.

In this instance, the determining whether to convert the path of the media to the specific storage portion may include converting the path of the determined forged media to the specific storage portion without using the temporary stack portion.

Also, the determining whether to convert the path of the media to the specific storage portion may include converting, to the specific storage portion, a path of normal media that circulates together with the temporary circulation path, when uncollected media is retracted from the media stored in the temporary stack portion.

Also, the determining whether to convert the path of the media to the media storage portion may include converting, to the media deposit portion, a path of normal media that circulates together with the temporary circulation portion, when depositing of the media stored in the temporary stack portion is cancelled.

Additional aspects, features, and/or advantages of the invention will be set forth in part in the description which follows and, in part, will be apparent from the description, or may be learned by practice of the invention.

BRIEF DESCRIPTION OF THE DRAWINGS

These and/or other aspects, features, and advantages of the invention will become apparent and more readily appreciated from the following description of exemplary embodiments, taken in conjunction with the accompanying drawings.

DETAILED DESCRIPTION

Figure 1:
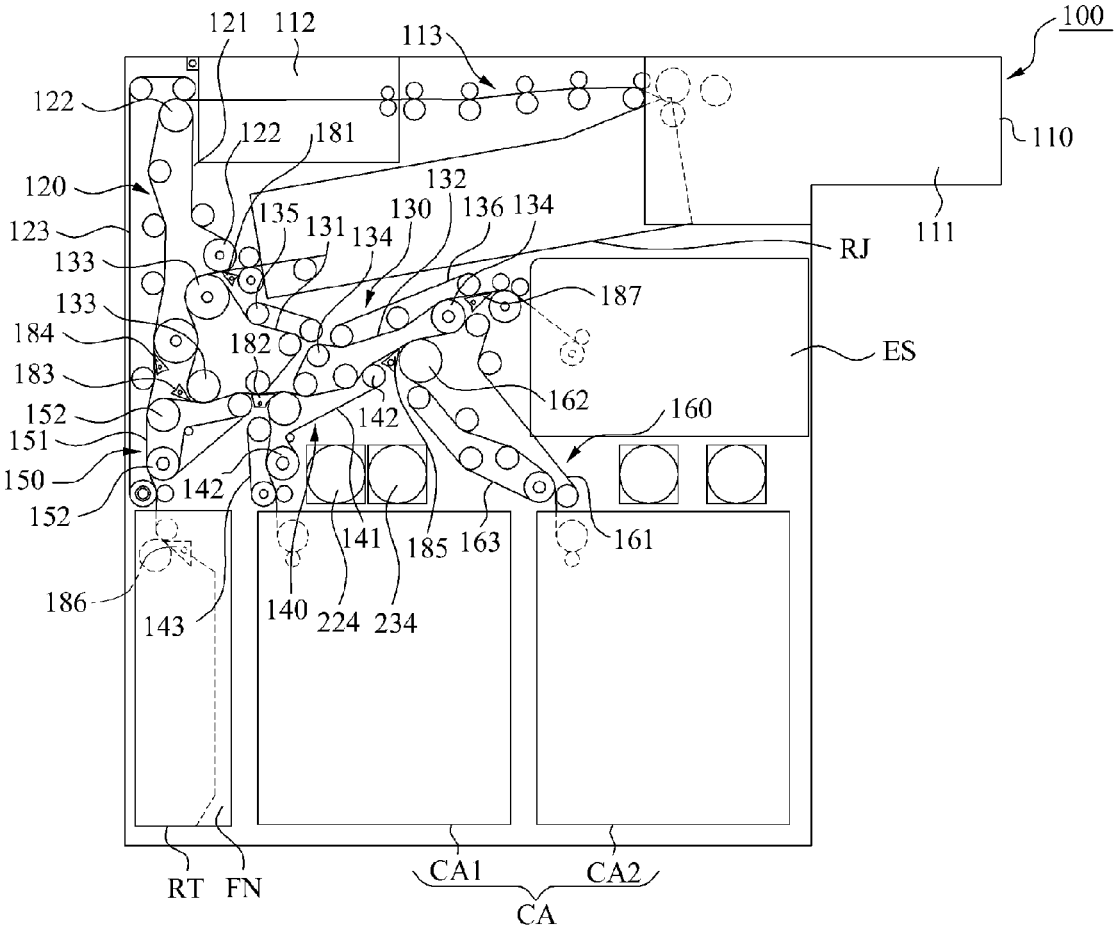
FIG. 1 is a cross-sectional view illustrating a media deposit apparatus according to an embodiment of the present invention.

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

Hereinafter, a configuration of a media deposit apparatus and an operation thereof according to an embodiment of the present invention will be described in detail with reference to the accompanying drawings. The following description will be one of various aspects and may constitute a portion of the detailed description regarding the present invention.

In describing the present invention, detailed description related to a known function or configuration will be omitted to make the purpose of the present invention clear.

Hereinafter, a media deposit apparatus for depositing paper media such as notes, checks, and the like according to an embodiment of the present invention will be described. However, the media deposit apparatus is only an example of an automatic teller machine (ATM) and may also be applicable to other types of ATMs such as a media depositing/withdrawing apparatus, and the like.

Figure 2:
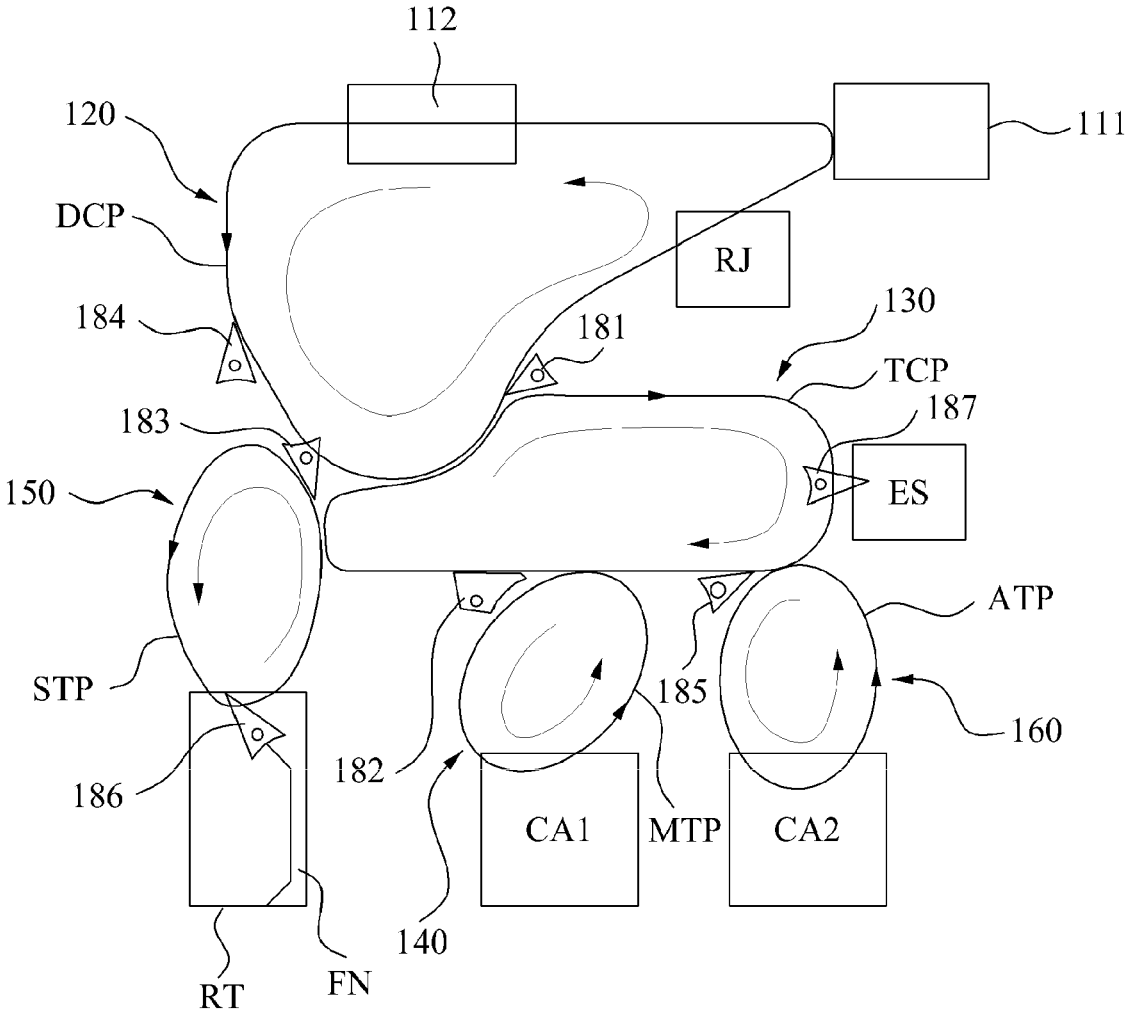
FIG. 2 is a cross-sectional view for describing a circulation direction of paths used in the media deposit apparatus of FIG. 1.

FIG. 1 is a cross-sectional view illustrating a media deposit apparatus 100 according to an embodiment of the present invention, and FIG. 2 is a cross-sectional view for describing a circulation direction of paths used in the media deposit apparatus 100 of FIG. 1.

As shown in FIGS. 1 and 2, the media deposit apparatus 100 includes a housing 110 that forms an external shape and internally includes various types of parts. A media deposit portion 111 is provided in one side of the housing 110 so that a customer may deposit media such as cash, checks, and the like.

Also, the housing 110 includes a plurality of belts and a plurality of rollers to form a plurality of paths for transferring the deposited media. The plurality of paths may include a deposit circulation path DCP, a temporary circulation path TCP, and a media transfer path MTP. Here, the deposit circulation path DCP may connect the media deposit portion 111 and a rejection portion, for example, a rejection box RJ (hereinafter, rejection portion RJ) for rejecting abnormal media among the deposited media. The temporary circulation path TCP may connect a temporary stack portion, for example, an escrow box ES (hereinafter, temporary stack portion ES), for temporarily storing normal media among the deposited media. The media transfer path MTP may connect the temporary circulation path TCP and a media storage portion, for example, a cassette box CA (hereinafter, a media storage portion CA) for receiving the temporarily stored media.

According to an embodiment of the present invention, the media deposit apparatus 100 may further include a specific transfer path STP that may connect the temporary circulation path TCP and a retraction portion, for example, a retraction box RT (hereinafter, retraction portion RT) for retracting uncollected media, or a specific storage portion, for example, a forged note box FN (hereinafter, specific storage portion FN) for storing forged media.

More specifically, the media deposited in the media deposit portion 111 may pass through a deposit path 113 that is formed on an outlet side of the media deposit portion 111. Here, it is assumed that the deposited media is paper money for ease of description. A plurality of rollers (not shown) may be provided in the outlet side of the media deposit portion 111 to send the deposited media to the deposit path 113.

The deposit path 113 may include two belts (not shown) that are provided to face each other and rollers to drive the belts. Also, the deposit path 113 may include a single belt and a guide surface (not shown) to face the single belt.

The media may be transferred to a media recognition portion 112 along the deposit path 113. The media recognition portion 112 may include various types of sensors, an image scanner, a magnetic ink character recognition (MICR), and the like, to thereby determine whether the deposited media is normal or abnormal. Specifically, the media recognition portion 112 may determine the abnormal media such as double-sheet media, folded media, and the like. Also, the media recognition portion 112 may determine whether the deposited media is forged.

Currently, as a forgery technology is being developed, a highly accurate sensor is being used to distinguish elaborately forged media from genuine media.

As a determination result at the media recognition portion 112, when the deposited media is abnormal media, for example, when the deposited media is partially torn or folded, it may be desirable to transfer the abnormal media to the rejection portion RJ in order to reject the deposited media, without processing the deposited media as a deposit. For this, the deposit circulation path DCP may be provided on an outlet side of the media recognition portion 112 and the rejection portion RJ may be mounted on one side of the deposit circulation path DCP. However, it is possible to process the abnormal media as the deposit without separately including the rejection portion RJ.

A deposit transfer portion 120 to form the deposit circulation path DCP may include a first belt 121 that provides a tightening force to the media and circulates into a predetermined direction, and a plurality of first rollers 122 that supports and drives the first belt 121.

A first auxiliary belt 123 and a plurality of rollers (not shown) to drive the first auxiliary belt 123 may be provided on one side of the first belt 121. The media may move between the first belt 121 and the first auxiliary belt 123 by the tightening force formed therebetween. In this instance, it is possible to transfer the media through the tightening force, formed between the first belt 121 and the guide surface, by including the guide surface instead of the first auxiliary belt 123. A plurality of idlers (not shown) may be mounted on the guide surface to support the first belt 121.

The media determined as normal media at the media recognition portion 112 may not pass through the rejection portion RJ and instead may be transferred to the temporary stack portion ES. The temporary stack portion ES may be a type of box that functions to temporarily store normal media. The reason why the media is temporarily stored in the temporary stack portion ES is to collect sheet-based media and process the collected media based on a stack unit and thereby to enhance a deposit processing efficiency. Since the temporary stack portion ES includes a drum (not shown) and a band (not shown), the temporary stack portion ES may wrap the media around the drum or the band and thereby temporarily store the media instead of piling up the media.

The temporary circulation path TCP may be formed between the deposit circulation path DCP and the temporary stack portion ES in order to transfer the media to the temporary stack portion ES. A temporary transfer portion 130 to form the temporary circulation path TCP may include a plurality of second belts 131 and 132 that circulates into a predetermined direction, and a plurality of second rollers 133 and 134 that drives the plurality of second belts 131 and 132.

In this instance, a singe belt, for example, the second belt 131 among the plurality of second belts 131 and 132 may circulate in a partial contact state with the first belt 121 of the deposit circulation path DCP. Specifically, the deposit circulation path DCP and the temporary circulation path TCP may partially share each other's path. The tightening force occurring in the shared path may make the media smoothly move.

In order to complete a depositing transaction of the media temporarily stored in the temporary stack portion ES, the media may be transferred to the media storage portion CA that is provided in a lower portion of the housing 110. The media transfer path MTP may be formed between the temporary stack portion ES and the media storage portion CA in order to transfer the media to the media storage portion CA.

Specifically, a portion of the media transfer path MTP may contact with the temporary circulation path TCP to thereby share a portion thereof. Another portion of the media transfer path MTP may be connected to the media storage portion CA. A media transfer portion 140 to form the media transfer path MTP may include a third belt 141 that gives a tightening force to the media and circulates into a predetermined direction, and a plurality of third rollers 142 that drive the third belt 141. In this instance, the third belt 141 may be provided in a partial contact state with the second belt 131.

Also, the specific transfer path STP may be formed to transfer, to the specific storage portion FN, forged media determined at the media recognition portion 112. The specific transfer path STP may contact with the temporary circulation path TCP to thereby share a portion thereof, and may also be connected to the specific storage portion FN. A specific transfer portion 150 to form the specific transfer path STP may include a fourth belt 151 that gives a tightening force to the media and circulates into a predetermined direction, and a plurality of fourth rollers 152 that drive the fourth belt 151. In this instance, the fourth belt 151 may be provided in a partial contact state with the plurality of second belts 131 and 132.

When a customer desires to continue a depositing transaction, the media temporarily stored in the temporary stack portion ES may be generally transferred from the temporary stack portion ES to the media storage portion CA. In this instance, the customer may not take any action for the media stored in the temporary stack portion ES. For example, when a predetermined period of time elapses in a state where the customer does not cancel the depositing transaction, or when the customer leaves a place, the media stored in the temporary stack portion ES may not be provided to the customer. In this case, there is a need to determine the stored media as uncollected media and thereby retract the uncollected media. For this, the retraction portion RT may be provided. Even in a case where the customer cancels the depositing transaction with respect to the media stored in the temporary stack portion ES and thus the media is returned to the media deposit portion 111, or when the customer does not take the media, the media may be retracted to the retraction portion RT.

The specific transfer path STP may be provided between the temporary circulation path TCP and the retraction portion RT in order to transfer the uncollected media from the temporary stack portion ES to the retraction portion RT. Specifically, the retraction portion RT and the specific storage portion FN may be integrally formed on the specific transfer path STP. Further detailed description related thereto will be made later.

Generally, normal media is more than uncollected media or forged media and thus a plurality of boxes for storing media may be provided. Referring to FIG. 1, the media storage portion CA may include two portions. In this case, the media storage portion CA may include a first media storage portion CA1 that is connected to the media transfer path MTP and a second media storage portion CA2 that is provided on one side of the first media storage portion CA1.

Here, an additional transfer path ATP may be further provided to transfer the media to the second media storage portion CA2. The additional transfer path ATP may contact with the temporary circulation path TCP to thereby share a portion thereof and may also be connected to the second media storage portion CA2.

An additional transfer portion 160 to form the additional transfer path ATP may include a fifth belt 161 that gives a tightening force to the media and circulates into a predetermined direction, and a plurality of fifth rollers 162 that drives the fifth belt 161. In this instance, the fifth belt 161 may be provided in a partial contact state with the second belt 131.

How many media storage portions are constructed is a matter of selection and thus it may be desirable to additionally provide a transfer path according to the added media storage portion.

The temporary circulation path TCP may be provided in a single path, or may be provided in two paths. Specifically, the temporary circulation path TCP may include a first temporary circulation that contacts with the deposit circulation path DCP and the specific transfer path STP, and a second temporary circulation path that contacts with the media transfer path MTP.

In this instance, the second belt 131 may contact with the first belt 121, and another second belt 132 may contact with the third belt 141. Specifically, the first temporary circulation path may include the second belt 131 that contacts with the first belt 121. The second temporary circulation path may include the second belt 132 that contacts with the third belt 141.

The reason to construct the temporary circulation path TCP into two paths is to prevent overloads from occurring at a driving unit during driving all the paths. Specifically, the first belt 121 of the deposit circulation path DCP, the fourth belt 151 of the specific transfer path STP, and the second belt 131 that simultaneously contacts with the deposit circulation path DCP and the specific transfer path STP may be circulated by a first driving unit 224. The other second belt 132 of the temporary circulation path TCP, the third belt 131 of the media transfer path MTP, and the fifth belt 161 of the additional transfer path ATP may be circulated by a second driving unit 234.

Since all the paths DCP, TCP, MTP, STP, and ATP are driven by the first driving unit 224 and the second driving unit 234, it is possible to decrease loads at the first driving unit 224 and the second driving unit 234 and thereby prevent overloads and increase in a power consumption.

Here, it may be more effective to additionally install an auxiliary belt on one side of the second belts 131 and 132 of the temporary circulation path TCP, that is, on one side opposite to a side where the media transfer path MTP or the additional transfer path ATP is formed. Specifically, it is possible to enhance a tightening force given to media towards the temporary stack portion ES by separately providing a plurality of second auxiliary belts 135 and 136 on the plurality of second belts 131 and 132, respectively.

Also, it is possible to further enhance a tightening force by providing a third auxiliary belt 143 on one side of the third belt 131 constituting the media transfer path MTP and by providing a fifth auxiliary belt 163 on one side of the fifth belt 161 forming the additional transfer path ATP.

An auxiliary belt may be provided even on one side of the fourth belt 151 forming the specific transfer path STP. Also, it is possible to extend the first auxiliary belt 123, provided on one side of the first belt 121 forming the deposit circulation path DCP, so that the first auxiliary belt 123 may contact with the fourth belt 151. Referring to FIG. 1, the first auxiliary belt 123 contacts with the fourth belt 151 of the specific transfer path STP. As described above, it is possible to enhance the tightening force by installing the guide surface instead of the above auxiliary belts.

In this instance, since the paths DCP, TCP, MTP, STP, and ATP or installation locations of the first through the fifth belts 121, 131, 141, 151, and 161 are fixed, the media may be misguided. For example, normal media between the deposit circulation path DCP and the temporary circulation path TCP may not be transferred towards the temporary circulation path TCP but may be transferred to the rejection portion RJ. Also, abnormal media may not be transferred to the rejection portion RJ but may be transferred to the temporary stack portion ES via the temporary circulation path TCP.

As described above, an additional device may be required to determine or to guide a transfer direction of corresponding media at a point where a contacting portion of the paths DCP, TCP, MTP, STP, and ATP ends. For this, a plurality of gates 181, 182, 183, 184, and 185 may be provided around the first through the fifth belts 121, 131, 141, 151, and 161, respectively, in order to selectively connect or disconnect the paths DCP, TCP, MTP, STP, and ATP.

The deposit transfer portion 120 may include a temporary stack gate 181 among the plurality of gates 181, 182, 183, 184, and 185. The temporary stack gate 181 may be provided at a location where a contact portion between the first belt 121 of the deposit circulation path DCP and the second belts 131 and 132 of the temporary circulation path TCP ends, that is, at a location where the media gets away from the contact portion between the first belt 121 and the second belts 131 and 132 based on a transfer direction of the media, to thereby guide the media to the rejection portion RJ or to the temporary circulation path TCP.

Here, the temporary stack gate 181 may perform a pivot motion to contact with the first belt 121 or with the second belts 131 and 132, and may determine the transfer direction of the media. For the pivot motion of the temporary stack gate 181, a solenoid (not shown) or a stepping motor (not shown) may be connected to a pivot axis of the temporary stack gate 181.

The temporary stack gate 181 may be provided between the deposit circulation path DCP and the temporary circulation path TCP to selectively convert a path of the media to the temporary circulation path TCP. Specifically, the temporary stack gate 181 may selectively convert the path of the media between the deposit circulation path DCP and the temporary circulation path TCP.

In order to smoothly guide the media, that is, in order to prevent the media from being stuck in the temporary stack gate 181, it may be desirable to form, in a wedge shape, an end of the temporary stack gate 181 that contacts with the first belt 121 or the second belts 131 and 132.

A media storage gate 182 may be provided between the temporary circulation path TCP and the media transfer path MTP. Specifically, the media transfer portion 140 may further include the media storage portion 182.

The media storage gate 182 functions to transfer, to the first media storage portion CA1, media that passes through a contact portion between the temporary circulation path TCP and the media transfer path MTP, or may transfer, to the specific transfer path STP, media that is temporarily stored in the temporary stack portion ES. The shape of the media storage gate 182 may be similar to the shape of the temporary stack gate 181. The media storage gate 182 may perform a pivot motion between the second belt 131 and the third belt 141.

The media storage gate 182 may be provided between the temporary circulation path TCP and the media transfer path MTP to selectively convert the path of the media to the media transfer path MTP.

A specific storage gate 183 may be provided between the temporary circulation path TCP and the specific transfer path STP to selectively convert the path of the media. Specifically, the specific transfer portion 150 may further include the specific storage gate 183.

The specific storage gate 183 functions to transfer, to the retraction portion RT or to the rejection portion RJ, the media that is transferred from the temporary stack portion ES along the temporary circulation path TCP. The shape of the specific storage gate 183 may be similar to the shape of the temporary stack gate 181 or the media storage gate 182. The specific storage gate 183 may perform a pivot motion between the second belts 131 and 132, and the fourth belt 151. The specific storage gate 183 may be installed at a location where a contact portion between the second belts 131 and 132, and the fourth belt 151 ends.

Also, a forged note retraction gate 184 may be provided on the deposit circulation path DCP that is adjacent to the specific transfer path STP. Specifically, the deposit transfer portion 120 may include the forged note retraction gate 184.

The forged note retraction gate 184 functions to transfer, to the specific storage portion FN and to the specific transfer path STP, media that is determined as forged media at the media recognition portion 112. Specifically, the forged media that is determined at the media recognition portion 112 may need to be immediately transferred to the specific storage portion FN without passing through the rejection portion RJ or the temporary stack portion ES. Accordingly, the forged note retraction gate 184 may be provided between the deposit circulation path DCP and the specific transfer path STP. Through this, it is possible to prevent the forged media from being transferred to the rejection portion RJ or the temporary stack portion ES.

When the media storage portion CA is added, the additional transfer portion 160 may further include an additional transfer gate 185 that is provided between the temporary circulation path TCP and the additional transfer path ATP. Specifically, the additional transfer gate 185 may be provided at a location where a contact portion between the second belts 131 and 132 of the temporary circulation path TCP and the fifth belt 161 of the additional transfer path ATP ends, to thereby guide normal media, temporarily stored in the temporary stack portion ES to the second media storage portion CA2.

When media is stored in the first media storage portion CA1 to the limit thereof and thus the second media storage portion CA2 is used, it is possible to transfer additional media to the second media storage portion CA2 using the additional transfer gate 185.

The shape of the additional transfer gate 185 may be similar to the shape of the aforementioned gates 181, 182, 183, and 184. The additional transfer gate 185 may perform a pivot motion between the second belts 131 and 132, and the fifth belt 161.

As described above, when the deposited media is determined, at the media recognition portion 112, as elaborately forged media, that is, a forged note that cannot be distinguished from genuine media, the specific storage portion FN may be further provided to retract the forged media.

The forged media determined at the media recognition portion 112 may be immediately transferred to the specific storage portion FN via the media deposit portion 111 and the media recognition portion 112 without passing through the rejection portion RJ or the temporary stack portion ES. Specifically, it may be desirable to construct transfer paths so that normal media, or torn or folded abnormal media may be transferred to the rejection portion RJ or the temporary stack portion ES, whereas the elaborately forged media may be immediately transferred to the specific storage portion FN without passing through the rejection portion RJ or the temporary stack portion ES.

Generally, an amount of forged media is less than an amount of normal media. Accordingly, when the specific storage portion FN is provided in the same size as the media storage portion CA or the retraction portion RT, it may increase the entire size of the media deposit apparatus 100, which may result in restricting an installation space of the media deposit apparatus 100.

Also, only a small amount of media is uncollected and thereby is transferred to the retraction portion RT. Accordingly, it may be advantageous in using a space to integrally form the retraction portion RT and the specific storage portion FN. Specifically, it may be desirable to form the specific storage portion FN within the retraction portion RT.

When the specific storage portion FN is provided within the retraction portion RT, an auxiliary gate 186 may be provided at a location where the specific transfer path STP is connected to the retraction portion RT. The auxiliary gate 186 functions to transfer, to the retraction portion RT, uncollected normal media that is transferred along the specific transfer path STP, or functions to transfer the forged media to the specific storage portion FN. The shape of the auxiliary gate 186 is similar to the shape of the aforementioned gates 181, 182, 183, 184, and 185.

A media guide 187 may be provided in a portion where the second belts 131 and 132 of the temporary circulation path TCP are connected to the temporary stack portion ES. The media guide 187 functions to connect an upper portion of the second belts 131 and 132, and the temporary stack portion ES, or to connect a lower portion of the second belts 131 and 132, and the temporary stack portion ES. Specifically, the temporary stack portion ES may receive or transfer the media via the single outlet. In this instance, it is possible to smoothly guide the media, transferred to and from the temporary stack portion, by providing the media guide 187 in a portion adjacent to the outlet.

The media to be transferred to the temporary stack portion ES along the temporary circulation path TCP may progress towards the temporary stack portion ES along an upper portion of the second belts 131 and 132. The media to be transferred from the temporary stack portion ES may progress towards the media transfer path MTP along the lower portion of the second belts 131 and 132. Accordingly, there is a need to selectively connect the temporary stack portion ES and either the upper portion or the lower portion of the second belts 131 and 132. The shape and the pivot motion of the media guide 187 may be the same as or similar to the aforementioned shape and the pivot motion of the gates 181, 182, 183, 184, 185, and 186.

Hereinafter, a structure of a path of transferring media will be further described in detail with reference to FIG. 3.

Figure 3:
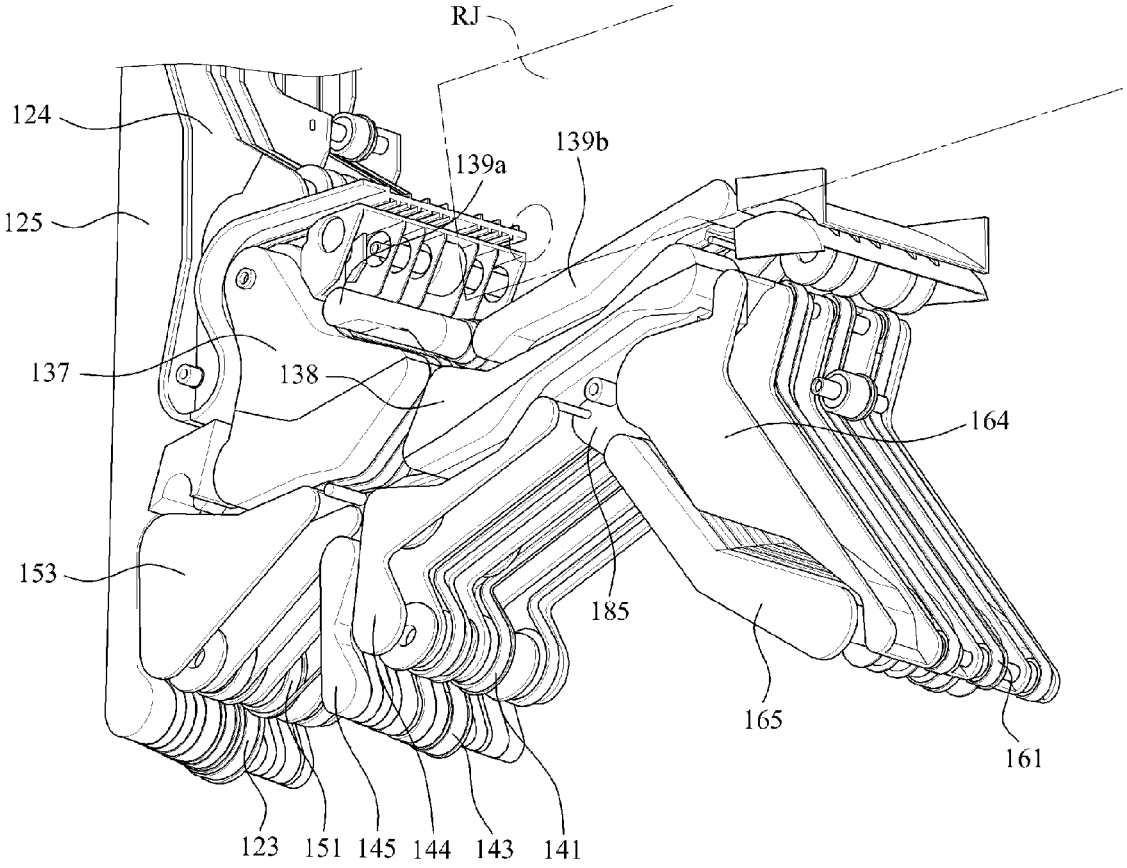
FIG. 3 is a perspective view illustrating components of the media deposit apparatus of FIG. 1.

FIG. 3 is a perspective view illustrating components of the media deposit apparatus 100 of FIG. 1. FIG. 2 illustrates frames that include belts and rollers to form the paths DCP, TCP, MTP, STP, and ATP. Hereinafter, a left-side portion of FIG. 3 will be described first for ease of description.

The first belt 121 and the first rollers 122 that form the deposit circulation path DCP may be mounted to a first frame 124. The first frame 124 is formed of a plurality of plate members that are spaced apart from each other at predetermined intervals. The first belt 121 or the first rollers 122 may be provided between plate members that are positioned in an approximately intermediate portion.

A first auxiliary frame 125 including the first auxiliary belt 123 may be provided on one side of the first frame 124. As described above, although not shown in the figures, the guide surface may be provided instead of mounting the first auxiliary belt 123 on the first auxiliary frame 125. Like the first frame 124, the first auxiliary frame 125 may also be formed of a plurality of plate members that are spaced apart from each other at predetermined intervals.

The second belts 131 and 132, and the second rollers 133 and 134 that form the temporary circulation path TCP may be mounted to second frames 137 and 138, respectively. When two second belts 131 and 132 are provided, it may be desirable to construct two second frames 137 and 138. Second auxiliary frames 139*a* and 139*b* for the second auxiliary belts 135 and 136 may be provided above the second frames 137 and 138, respectively. Each of the second frames 137 and 138, and the second auxiliary frames 139*a* and 139*b* may be formed of a plurality of plate members that are spaced apart from each other at predetermined intervals.

The third belt 141 and the third roller 142 that form the media transfer path MTP may be mounted to a third frame 144. A third auxiliary frame 145 may be provided on one side of the third frame 144 to install the third auxiliary belt 143. Here, each of the third frame 144 and the third auxiliary frame 145 may be formed of a plurality of plate members that are spaced apart from each other at predetermined intervals. It may be desirable to provide the third belt 141 and the third auxiliary belt 143 between the plate members that are positioned in an approximately intermediate portion.

A fourth frame 153 that forms the specific transfer path STP may be provided on a left side of the third frame 144. A fifth frame 164 that forms the additional transfer path ATP may be provided on a right side of the third frame 144. The fourth frame 153 may be formed of a plurality of plate members. The fourth belt 151 may be provided between plate members that are positioned in an approximately intermediate portion.

Also, the fifth frame 164 may be formed of a plurality of plate members that are spaced apart from each other at predetermined intervals. It may be desirable to provide the fifth belt 161 between plate members that are positioned in an approximately intermediate portion. Here, a fifth auxiliary frame 165 may be provided to be adjacent to the fifth frame 164.

It has been described above that belts or auxiliary belts are provided in a single row in the approximately intermediate portion, but the present invention is not limited thereto. Specifically, when transferring media in a longitudinal direction, that is, a lengthwise direction of the media, a single row of belt may be provided in the middle of each of frames. Conversely, when transferring the media in a converse direction, that is, a widthwise direction of the media, at least two rows of belts may be provided to be in parallel with the transfer direction of the media.

It may be desirable that the gates 181, 182, 183, 184, and 185 may perform the pivot motion in a partially overlapping state with the first through the fifth frames (124, 137, 138, 144, 153, and 164). Specifically, since the ends of the gates 181, 182, 183, 184 and 185 are received in gaps between the plate members of the first through the fifth frames (124, 137, 138, 144, 153, and 164), and thereby are partially overlapped, it is possible to prevent the media from being transferred to a wrong path and to guarantee an accurate transfer of the media.

Hereinafter, an operation of the media deposit apparatus 100 will be described with reference to FIGS. 1 through 3, and FIGS. 4A through 4F.

Figure 4A:
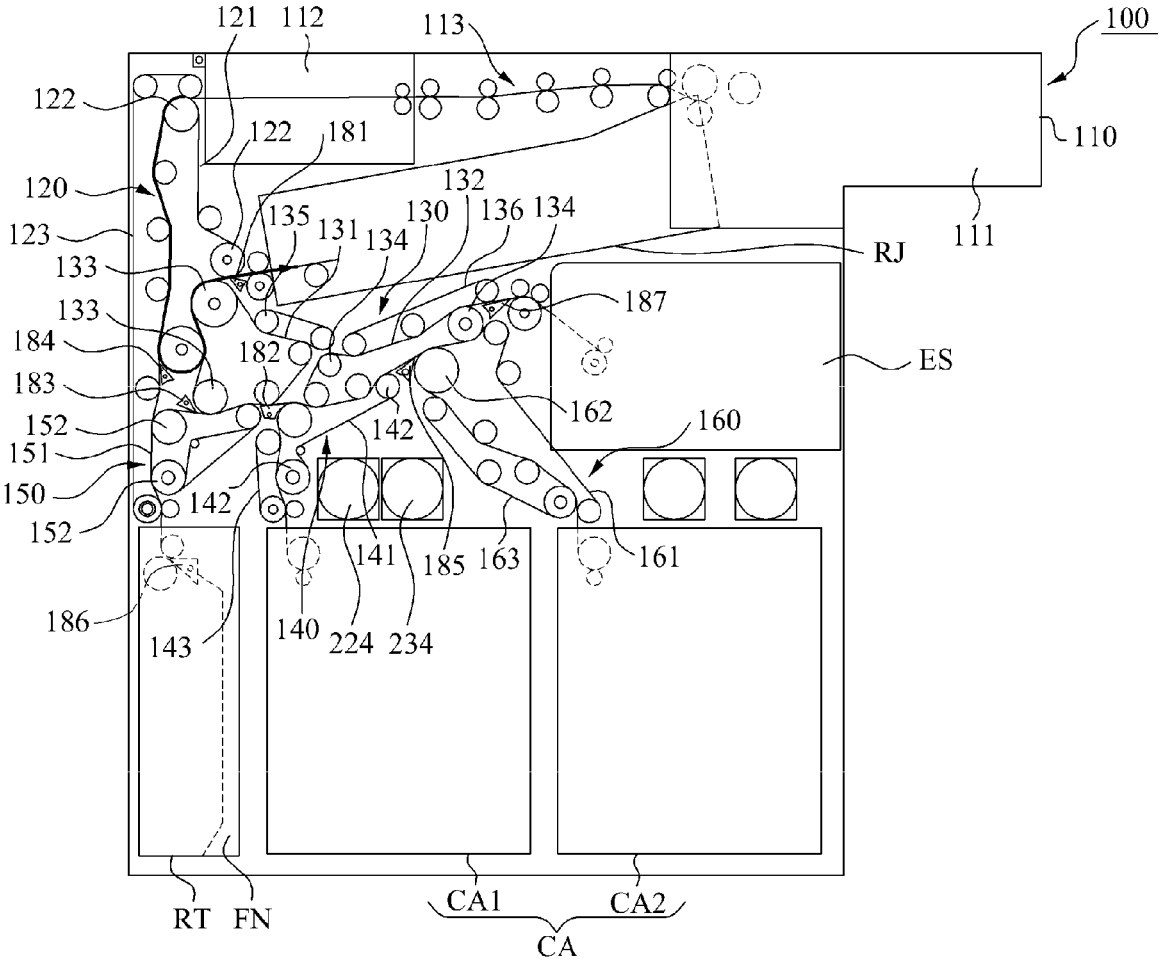
FIGS. 4A, 4B, 4C, 4D, 4E, and 4F are cross-sectional views for describing paths of transferring media in the media deposit apparatus of FIG. 1.

FIG. 4A illustrates a path of transferring, to the rejection portion RJ, abnormal media determined at the media recognition portion 112. In order to transfer, to the rejection portion RJ, media that passes through a contact portion between the first belt 121 of the deposit circulation path DCP and the second belts 131 and 132 of the temporary circulation path TCP, the temporary stack gate 181 may need to contact with the second belts 131 and 132 and thereby prevent the media from progressing towards the temporary circulation path TCP. Specifically, the temporary stack gate 181 may contact with the second belts 131 and 132 whereby a passage or a gap for progressing the media may be formed between the first belt 121 and the temporary stack gate 181. The media may be transferred to the rejection portion RJ via the passage or the gap.

Figure 4B:
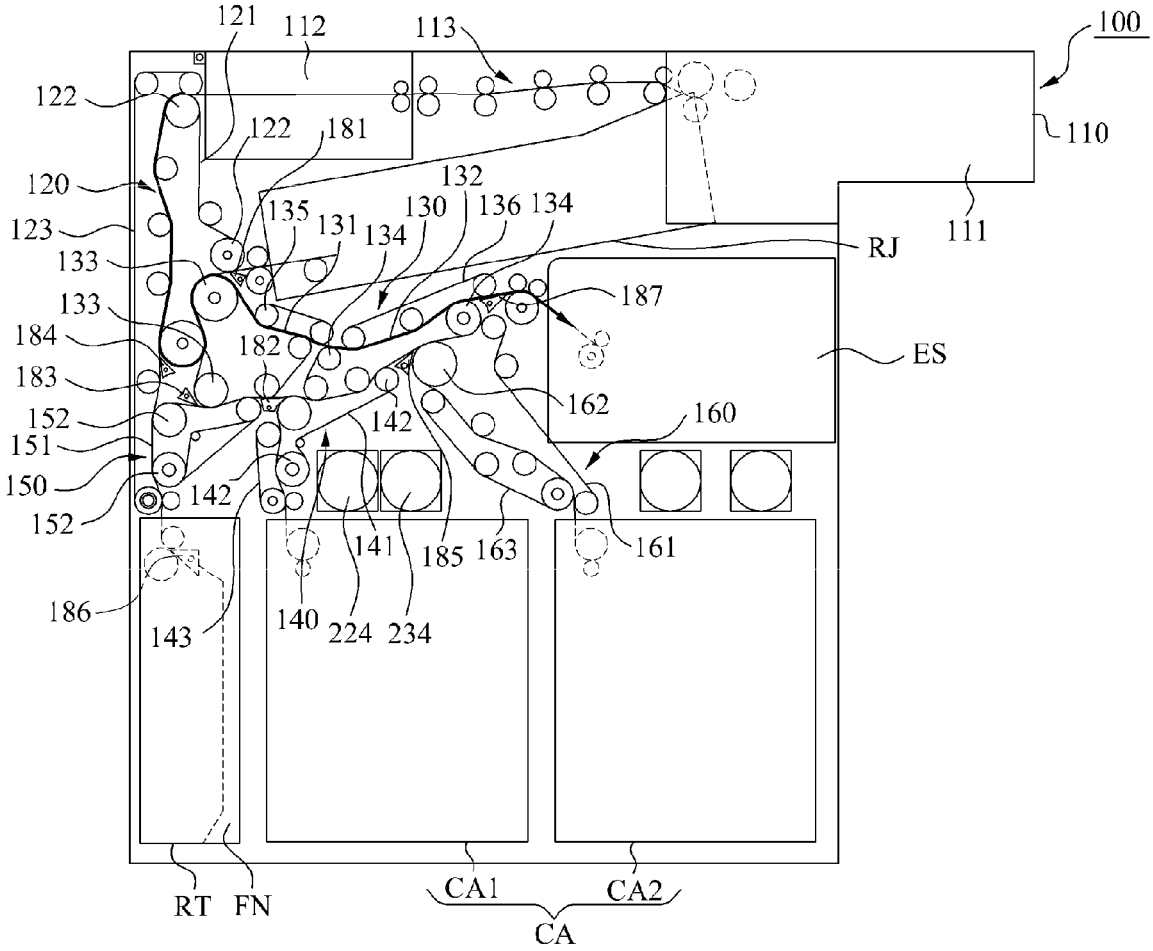

FIG. 4B illustrates a path of transferring, to the temporary stack portion ES, normal media determined at the media recognition portion 112. In order to transfer the determined normal media to the temporary stack portion ES, the temporary stack gate 181 may be separated from the second belts 131 and 132 to thereby contact with the first belt 121. Through this, a passage or a gap may be formed between the temporary stack gate 181 and the second belts 131 and 132. The media may be transferred to the temporary stack portion ES via the passage or the gap.

Figure 4C:
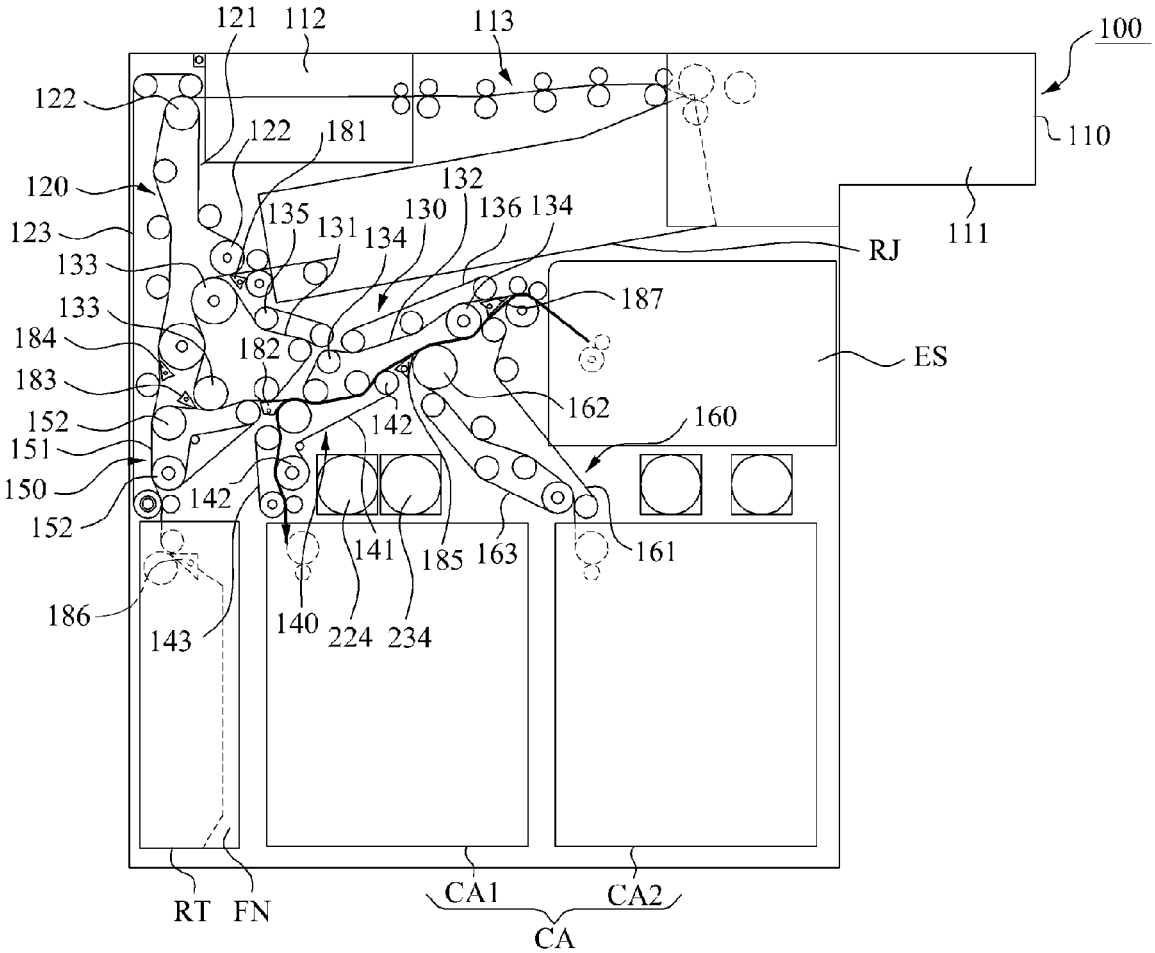

FIG. 4C illustrates a path of transferring, to the first media storage portion CA1, normal media that is temporarily stored in the temporary stack portion ES. In order to transfer, to the first media storage portion CA1, the media that is temporarily stored in the temporary stack portion ES, the media guide 187 may perform a pivot motion so that the stored media may be transferred along a lower portion of the second belts 131 and 132. The media storage gate 182 may contact with the second belts 131 and 132 so that the media being transferred along the lower portion of the second belts 131 and 132 may pass through a contact portion between the second belts 131 and 132, and the third belt 141 and then be transferred towards the media transfer path MTP.

The media may need to initially pass through the contact portion between the second belts 131 and 132, and the third belt 141 and then be transferred to the media transfer path MTP. For this, the media storage gate 182 may contact with the second belts 131 and 132 whereby a predetermined interval of passage or gap may be formed between the third belt 141 and the media storage gate 182. The media may be transferred to the first media storage portion CA1 via the passage or the gap.

Figure 4D:
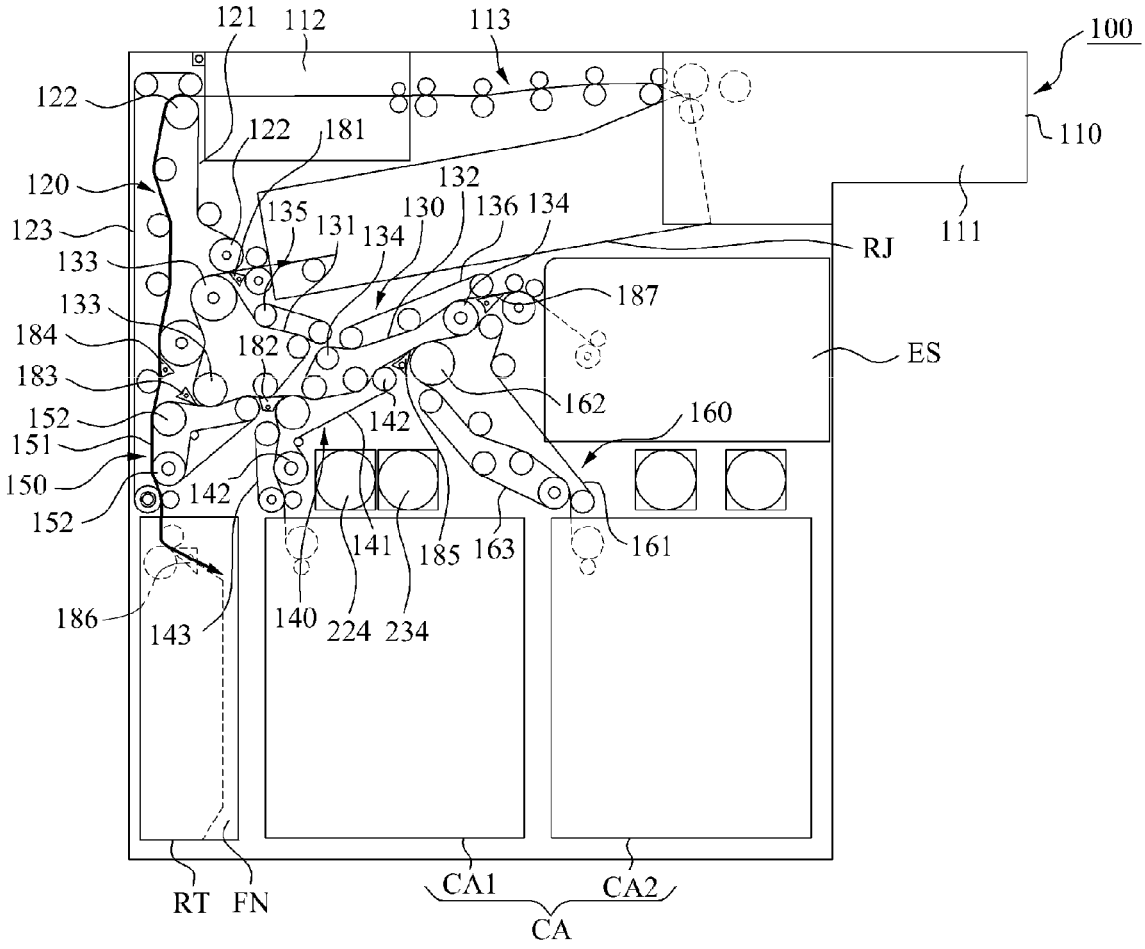

FIG. 4D illustrates a path of transferring forged media determined at the media recognition portion 112. In the case of forged media determined at the media recognition portion 112, the media may need to be immediately transferred to the specific transfer path STP and the specific storage portion FN without passing through the rejection portion RJ or the temporary stack portion ES. Specifically, it is possible to prevent the forged media from being transferred to the temporary circulation path TCP using the forged note gate 184. Accordingly, the forged media may pass through the specific transfer path STP and then be immediately stored in the specific storage portion FN. Also, a path for retracting the forged media may be formed to be short.

Figure 4E:
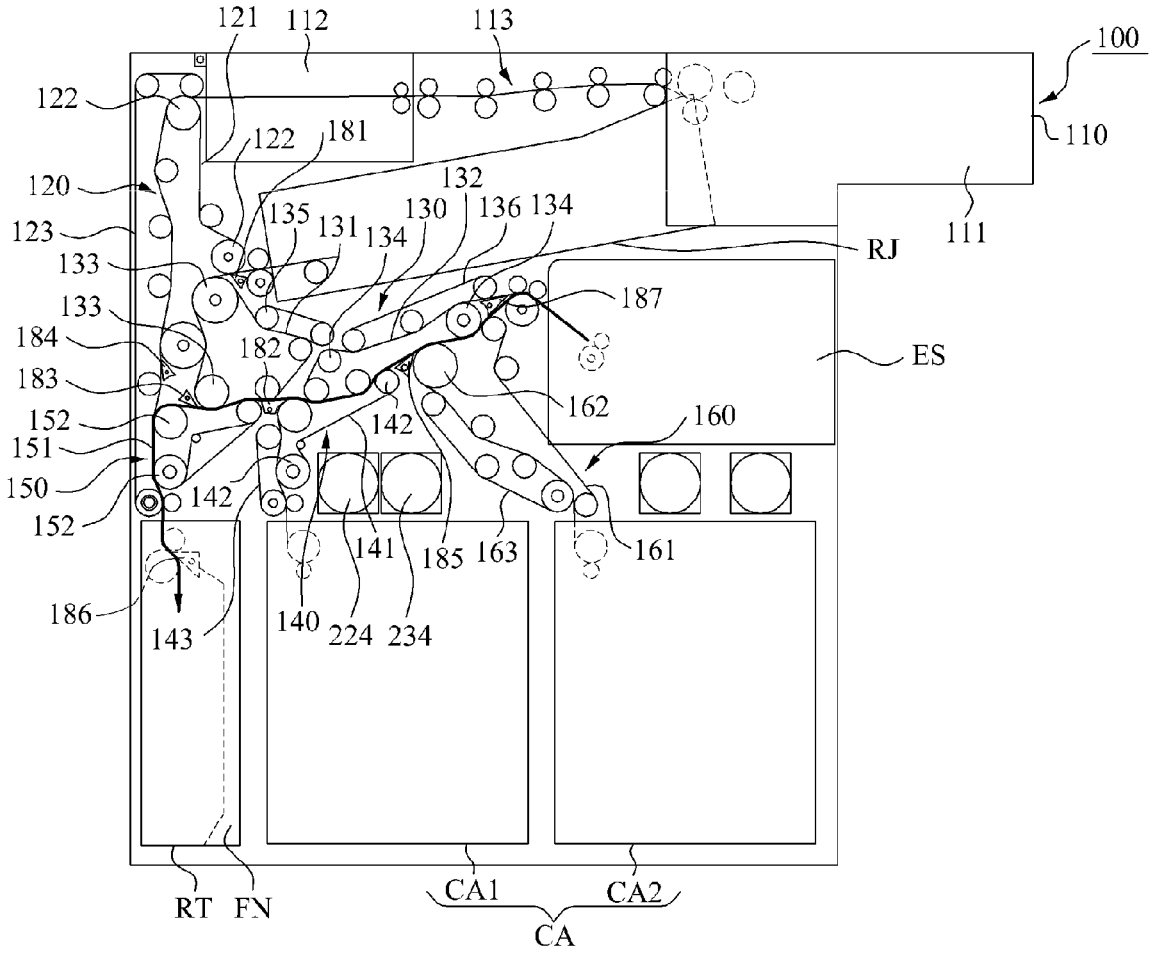

FIG. 4E illustrates a path for transferring uncollected media from the temporary stack portion ES to the retraction portion RT. When the media stored in the temporary stack portion ES is transferred to the retraction portion RT, the stored media may progress along the lower portion of the second belt 131 via the media guide 187. Next, the media storage gate 182 may contact with the third belt 141 to thereby transfer the media towards the specific transfer path STP. In order to transfer, to the retraction portion RT, the media that passes through a passage or a gap between the second belts 131 and 132, and the third belt 141, the specific storage gate 183 may contact with the second belts 131 and 132. The media passing through the specific transfer path STP via the passage or the gap between the specific storage gate 183 and the fourth belt 151 may be transferred to the retraction portion RT via the auxiliary gate 186.

Figure 4F:
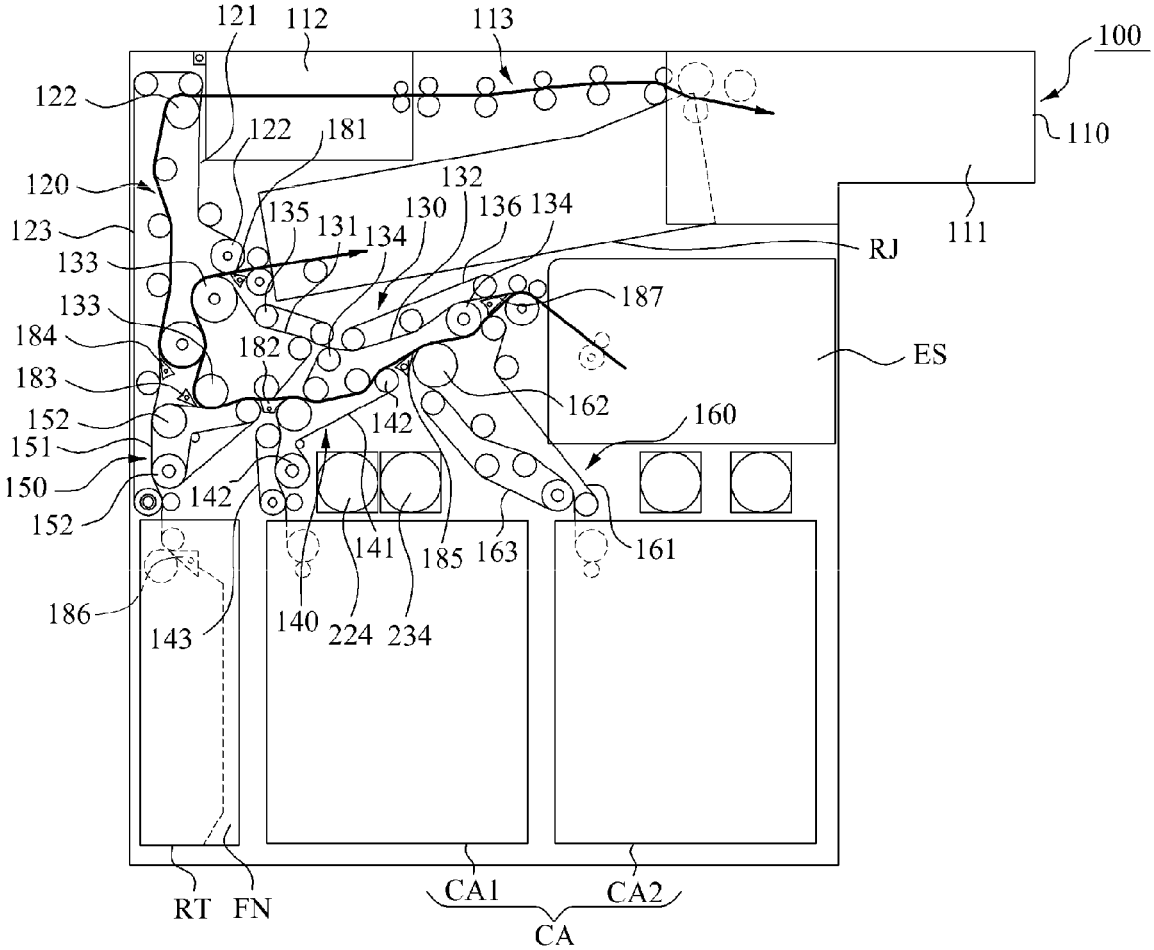

FIG. 4F illustrates a path of returning media that is temporarily stored in the temporary stack portion ES but of which depositing is cancelled. When a customer cancels a depositing transaction for the media that is stored in the temporary stack portion ES, the media may need to be returned to the media deposit portion 111. Specifically, the media may be dispensed into a direction opposite to a direction that the media is transferred to the temporary stack portion ES and then be returned into the clockwise direction of the temporary circulation path TCP and be transferred to the media deposit portion 111 via the rejection portion RJ.

When transferring media to the second media storage portion CA2, its operational principle may be the same as the aforementioned operational principle when transferring the media to the first media storage portion CA1. Accordingly, further detailed descriptions related thereto will be omitted here.

FIG. 2 illustrates circulation directions of the paths DCP, TCP, MTP, STP, and ATP used in the media deposit apparatus 100 of FIG. 1.

Referring to FIG. 2, all the deposit circulation path DCP, the media transfer path MTP, the specific transfer STP, and the additional transfer path ATP circulate in the same direction, whereas the temporary circulation path TCP circulates in the opposite direction. This is because the deposit circulation path DCP, the media transfer path MTP, the specific transfer path STP, and the additional transfer path ATP circulate in a contact state with the temporary circulation path TCP.

The above paths DCP, TCP, MTP, STP, and ATP may circulate into the predetermined direction in the media deposit apparatus 100 according to an embodiment. While maintaining the circulation direction as is, media may be transferred to each corresponding storage portion.

Specifically, it is possible to selectively convert a path of media without changing the circulation direction of the paths DCP, TCP, MTP, STP, and ATP by using the plurality of gates 181, 182, 183, 184, 185, and 186. Accordingly, it may be possible to reduce an inconvenience of changing the circulation direction and to simplify a media transfer structure.

The media deposit apparatus 100 having the five paths DCP, TCP, MTP, STP, and ATP has been described above, but the present invention is not limited thereto. Specifically, a number of paths may increase or decrease depending on a number of media storage portions, the size of the media deposit apparatus 100, and the like. Also, whether to install the rejection portion RJ or the media storage portion CA may be determined based on a location or a space where the media deposit apparatus 100 is installed.

Figure 5:
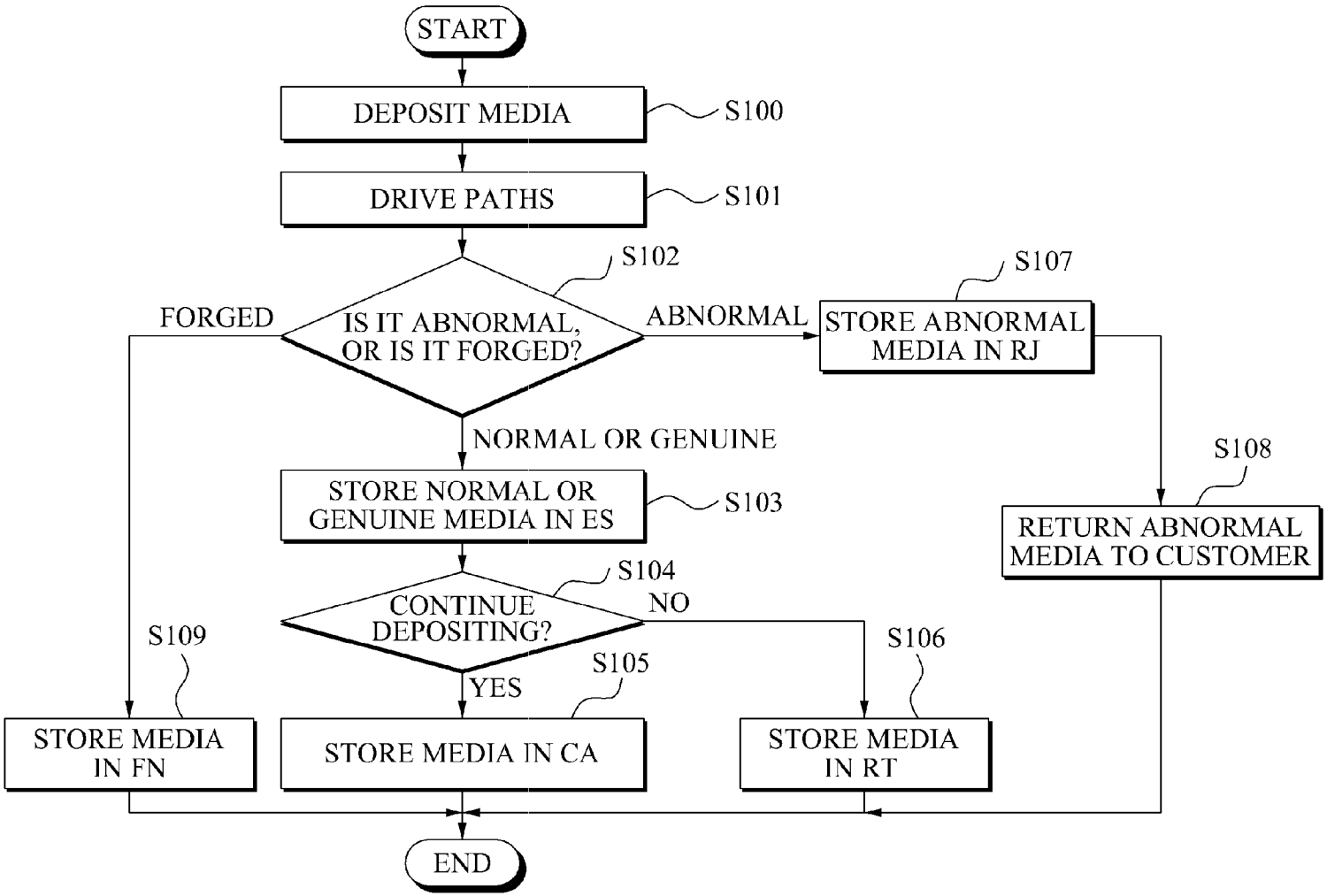
FIG. 5 is a flowchart illustrating a method of controlling the media deposit apparatus of FIG. 1 according to an embodiment of the present invention.

Hereinafter, a method of controlling the media deposit apparatus 100 according to an embodiment of the present invention will be described with reference to FIG. 5. FIG. 5 is a flowchart illustrating a method of controlling the media deposit apparatus 100 according to an embodiment of the present invention.

As shown in FIG. 5, the method of controlling the media deposit apparatus 100 may include operation S100 of depositing media, operation S101 of driving paths DCP, TCP, MTP, STP, and ATP to transfer the deposited media, operation S102 of determining whether the deposited media is abnormal or whether the deposited media is forged, operation S107 of transferring the media to a rejection portion, for example, a rejection box RJ when the deposited media is determined as abnormal media, operation S103 of transferring and temporarily storing the media in a temporary stack portion, for example, an escrow box ES when the deposited media is determined as normal or genuine media, operation S105 of transferring the temporarily stored media to a media storage portion, for example, a cassette box CA to thereby perform depositing of the normal or genuine media, operation S106 of transferring media to a retraction portion, for example, a retraction box RT when depositing of the media is cancelled, or when media returned to a media deposit portion 111 is uncollected, and operation S109 of transferring media to a specific storage portion, for example, a forged note box FN when forged media is included in the deposited media.

Here, in operation S109, the forged media may be immediately transferred to the specific storage portion FN without passing through the temporary stack portion ES or the rejection portion RJ.

Referring again to FIG. 5, in operation S100, a customer may deposit the media via the media deposit portion 111. In operation S101, the paths DCP, TCP, MTP, STP, and ATP may be driven to transfer the deposited media.

In this instance, the paths (DCP, TCP, MTP, STP, and ATP) may maintain their own predetermined circulation direction.

Initially, the deposit circulation path DCP among the paths DCP, TCP, MTP, STP, and ATP may be driven. The media deposited via the media deposit portion 111 may be transferred in a sheet unit along the deposit circulation path DCP. A path of the media may be selectively converted to the temporary circulation path TCP using the temporary stack gate 181 that is provided between the deposit circulation path DCP and the temporary circulation path TCP.

In operation S102, while the deposited media passes through the media recognition portion 112, it is determined whether the media is abnormal or whether the media is forged. The media passing through the media recognition portion 112 may be transferred to the temporary circulation path TCP.

When the media is determined as abnormal media such as torn media or folded media in operation S102, it is determined whether to convert a path of the abnormal media to the rejection portion RJ and the abnormal media is transferred to the rejection portion RJ depending on a determination result in operation S107. The abnormal media transferred to the rejection portion RJ may be returned to the customer in operation S108.

The media that is determined as normal or genuine media in operation S102 may be transferred to the temporary stack portion ES and be temporarily stored in the temporary stack portion ES in operation S103. For this, the temporary stack portion ES may be driven together in contact with the deposit circulation path DCP. The temporary circulation path TCP may be provided between the deposit circulation path DCP and the temporary stack portion ES. In this instance, it is determined whether to convert the path of the media to the temporary stack portion ES using the temporary stack gate 181. Specifically, the path of normal media or genuine media may be converted to the temporary stack portion ES. A path of forged media may not be converted to the temporary stack portion Es and may be immediately transferred to the specific storage portion FN.

When the normal media is stored in the temporary stack portion ES, it is determined whether to continue a depositing transaction for the media stored in the temporary stack portion ES in operation S104. When it is determined to not continue the depositing transaction, or when the depositing transaction is cancelled and thus the media transferred to the media deposit portion 11 is uncollected, the uncollected media may be transferred to the retraction portion RT in operation S106 or may be returned to the media deposit portion 111.

The above operation of determining whether to convert the path of the media to the media storage portion CA may further include converting, to the media deposit portion 111, a path of normal media that circulates together with the temporary circulation path TCP, when depositing of the media stored in the temporary stack portion ES is cancelled.

For this, it may be determined whether to convert, to the media storage portion CA, the path of the media that circulates together with the temporary circulation path TCP. Specifically, it may be determined whether to selectively convert the path of the media to the media transfer path MTP. During this process, normal media or genuine media may be transferred to the media storage portion CA along the media transfer path MTP whereby the depositing transaction may be completed in operation S105.

When the deposited media is determined as forged media in operation S102, the forged media may be immediately transferred to the specific storage portion FN without passing through the rejection portion RJ or the temporary stack portion ES in operation S109. For this, it may be determined whether to convert, to the specific storage portion FN, the path of the media that circulates together with the temporary circulation path TCP.

The paths DCP, TCP, MTP, STP, and ATP of media to be transferred to corresponding storage portions RJ, ES, CA, RT, and FN may be determined by a pivot motion of the gates 181, 182, 183, 184, 185, and 186.

Also, the above operation of determining whether to convert the path of the media to the specific storage portion FN may include converting, to the specific storage portion FN or the retraction portion RT, a path of normal media that circulates together with the temporary circulation path TCP, when the media stored in the temporary stack portion ES is uncollected.

A method of controlling the gates 181, 182, 183, 184, 185, and 186 to control a media transfer will be the same as the aforementioned method and thus further detailed descriptions related thereto will be omitted here.

As described above, according to embodiments of the present invention, paths for transferring media may partially share the paths with each other and thus it is possible to simplify a media path structure.

Also, according to embodiments of the present invention, in a state where a plurality of paths maintains their own predetermined circulation direction, a path of media may be determined by a pivot motion of gates that are formed between the plurality of paths. Accordingly, it is possible to enhance a media transfer efficiency and to reduce an inconvenience of changing the circulation direction of the paths.

Also, according to embodiments of the present invention, it is possible to quickly separate forged media and to distinguish a transfer path of the forged or abnormal media from a transfer path of genuine or normal media. Through this, it is possible to effectively transfer the normal or genuine media.

Also, according to embodiments of the present invention, since a driving unit to drive a plurality of media paths is separated, it is possible to prevent overloads and to enhance a convenience of maintaining and repairing a media deposit apparatus.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A media deposit apparatus comprising:

a media deposit portion configured to receive media from a customer;

a deposit transfer portion configured to provide a deposit circulation path extending from the media deposit portion to carry media for depositing or withdrawal in one direction but not in the other direction;

a temporary transfer portion configured to provide a temporary circulation path coupled to the deposit circulation path to transfer media that are not forged to a temporary stack portion;

a temporary stack gate on the deposit circulation path to selectively transfer one or more of media on the deposit circulation path to the temporary circulation path, wherein media not selected by the temporary stack gate continues to move on the deposit circulation path to a reject portion for holding abnormal media;

a forged note retraction gate on the deposit circulation path between the media deposit portion and the temporary stack gate, the forged note retraction gate configured to transfer media determined as forged to a specific transfer path connected to a specific storage portion storing the forged media without using the temporary stack portion, the specific storage portion separate from the reject portion and placed in a retraction portion for retracting media uncollected by the customer, wherein the uncollected media is transferred to the retraction portion via the deposit transfer portion, the temporary transfer portion and the specific transfer portion; and a media transfer portion configured to provide a media transfer path coupled to the temporary circulation path to transfer one or more media to a media storage portion;

wherein the temporary transfer portion is configured to transfer the media on the temporary circulation path in one direction but not in an opposite direction, the media transfer portion configured to transfer the one or more media on the media transfer path in one direction but not in an opposite direction, the specific storage portion transfers the media on the specific transfer path in one direction but not in an opposite direction, and the deposit transfer portion is configured to transfer the media on the deposit circulation path in one direction but not in an opposite direction.

2. The media deposit apparatus of claim 1, wherein the temporary transfer portion is configured to transfer individual sheets of media to the temporary stack portion, or to receive individual sheets of media from the temporary stack portion.

3. The media deposit apparatus of claim 2, wherein:

the temporary stack portion transfers or receives media via a single outlet, and the temporary transfer portion comprises a media guide that is provided to be adjacent to the outlet of the temporary stack portion.

4. The media deposit apparatus of claim 1, further comprising a media storage gate configured to select and transfer one or more media from the temporary circulation path to the media transfer path.

5. The media deposit apparatus of claim 1, further comprising a media recognition portion on the deposit circulation path between the media deposit portion and the forged note retraction gate, the media recognition portion configured to detect forged media.

* * * * *